US008393882B2

(12) United States Patent
Ignatiev et al.

(10) Patent No.: US 8,393,882 B2
(45) **Date of Patent: *Mar. 12, 2013**

(54) SCROLL COMPRESSOR WITH ROTARY DISCHARGE VALVE

(75) Inventors: Kirill Ignatiev, Sidney, OH (US); James J. Fogt, Sidney, OH (US)

(73) Assignee: Emerson Climate Technologies, Inc., Sidney, OH (US)

( * ) Notice: Subject to any disclaimer, the term of this patent is extended or adjusted under 35 U.S.C. 154(b) by 116 days.

This patent is subject to a terminal disclaimer.

(21) Appl. No.: 13/036,529

(22) Filed: Feb. 28, 2011

(65) Prior Publication Data

US 2011/0150688 A1 Jun. 23, 2011

Related U.S. Application Data

(63) Continuation of application No. 12/103,265, filed on Apr. 15, 2008, now Pat. No. 7,896,629, which is a continuation of application No. 11/522,250, filed on Sep. 15, 2006, now Pat. No. 7,371,059.

(51) Int. Cl.
*F01C 1/02* (2006.01)
*F03C 2/00* (2006.01)

(52) U.S. Cl. ..... 418/55.1; 418/55.2; 418/270

(58) Field of Classification Search ..... 418/55.1–55.6, 418/57, 151, 270, 181
See application file for complete search history.

(56) References Cited

U.S. PATENT DOCUMENTS

| | | | |
|---|---|---|---|
| 4,466,784 | A | 8/1984 | Hiraga |
| 4,475,875 | A | 10/1984 | Sugimoto et al. |
| 4,552,518 | A | 11/1985 | Utter |
| 4,650,405 | A | 3/1987 | Iwanami et al. |
| 4,838,773 | A | 6/1989 | Noboru |
| 4,842,499 | A | 6/1989 | Nishida et al. |
| 4,886,433 | A | 12/1989 | Maier |
| 4,898,520 | A | 2/1990 | Nieter et al. |
| 4,990,071 | A | 2/1991 | Sugimoto |
| 5,024,589 | A | 6/1991 | Jetzer et al. |

(Continued)

FOREIGN PATENT DOCUMENTS

| | | | |
|---|---|---|---|
| JP | 03233101 | A | 10/1991 |
| JP | 2003214365 | A | 7/2003 |

(Continued)

OTHER PUBLICATIONS

Notification of the First Office Action received from the Chinese Patent Office dated Mar. 6, 2009 regarding Application No. 200710153687.2,translated by CCPIT Patent and Trademark Law Office.

(Continued)

*Primary Examiner* — Theresa Trieu
(74) *Attorney, Agent, or Firm* — Harness, Dickey & Pierce, P.L.C.

(57) ABSTRACT

A scroll compressor is provided and may include an orbiting scroll member having an orbiting end plate and an orbiting spiral wrap extending from the orbiting end plate. The scroll compressor may also include a non-orbiting scroll member having a non-orbiting end plate and a non-orbiting spiral wrap extending from the non-orbiting end plate and intermeshed with the orbiting spiral wrap. The scroll compressor may further include a drive member for causing the orbiting scroll member to orbit relative to the non-orbiting scroll member and a discharge slot formed by one of the orbiting scroll member and the non-orbiting scroll member. A discharge valve may be rotatable with the drive member and may operate between a closed state preventing fluid communication between the pockets and the discharge slot and an open state permitting fluid communication between the pockets and the discharge slot.

21 Claims, 12 Drawing Sheets

U.S. PATENT DOCUMENTS

| | | | |
|---|---|---|---|
| 5,040,958 | A | 8/1991 | Arata et al. |
| 5,098,265 | A | 3/1992 | Machida et al. |
| 5,145,346 | A | 9/1992 | Iio et al. |
| 5,152,682 | A | 10/1992 | Morozumi et al. |
| 5,171,141 | A | 12/1992 | Morozumi et al. |
| 5,199,862 | A | 4/1993 | Kondo et al. |
| 5,213,489 | A | 5/1993 | Kawahara et al. |
| 5,304,047 | A | 4/1994 | Shibamoto |
| 5,318,424 | A | 6/1994 | Bush et al. |
| 5,336,068 | A | 8/1994 | Sekiya et al. |
| 5,340,287 | A | 8/1994 | Kawahara et al. |
| 5,425,626 | A | 6/1995 | Tojo et al. |
| 5,427,512 | A | 6/1995 | Kohsokabe et al. |
| 5,458,471 | A | 10/1995 | Ni |
| 5,458,472 | A | 10/1995 | Kobayashi et al. |
| 5,547,354 | A | 8/1996 | Shimizu et al. |
| 5,624,247 | A | 4/1997 | Nakamura |
| 5,649,817 | A | 7/1997 | Yamazaki |
| 5,775,893 | A | 7/1998 | Takao et al. |
| 5,842,843 | A | 12/1998 | Haga |
| 5,938,417 | A | 8/1999 | Takao et al. |
| 6,030,192 | A | 2/2000 | Hill et al. |
| 6,068,459 | A | 5/2000 | Clarke et al. |
| 6,093,005 | A | 7/2000 | Nakamura |
| 6,152,714 | A | 11/2000 | Mitsuya et al. |
| 6,174,149 | B1 | 1/2001 | Bush |
| 6,257,840 | B1 | 7/2001 | Ignatiev et al. |
| 6,264,444 | B1 | 7/2001 | Nakane et al. |
| 6,290,477 | B1 | 9/2001 | Gigon |
| 6,338,912 | B1 | 1/2002 | Ban et al. |
| 6,361,890 | B1 | 3/2002 | Ban et al. |
| 6,705,848 | B2 | 3/2004 | Scancarello |
| 6,746,223 | B2 | 6/2004 | Manole |
| 6,887,051 | B2 | 5/2005 | Sakuda et al. |
| 7,371,059 | B2 * | 5/2008 | Ignatiev et al. ..... 418/151 |
| 7,896,629 | B2 * | 3/2011 | Ignatiev et al. ..... 418/55.1 |

FOREIGN PATENT DOCUMENTS

| | | | |
|---|---|---|---|
| JP | 2005264827 | A | 9/2005 |

OTHER PUBLICATIONS

Notice of Grounds for Rejection regarding Korean Patent Application No. 10-2007-0093478 dated Feb. 25, 2010. Translation provided by Y.S. Chang & Associates.

Final Preliminary Notice of Grounds for Rejection regarding Korean Patent Application No. 10-2007-0093478, dated Aug. 31, 2010. Translation provided by Y.S. Chang & Associates.

Non-Final Office Action for U.S. Appl. No. 11/522,250, dated Aug. 1, 2007.

Non-Final Office Action for U.S. Appl. No. 12/103,265, dated May 27, 2009.

Non-Final Office Action for U.S. Appl. No. 12/103,265, dated Dec. 17, 2009.

Final Office Action for U.S. Appl. No. 12/103,265, dated Jun. 15, 2010.

Advisory Action for U.S. Appl. No. 12/103,265, dated Sep. 17, 2010.

First Examination Report regarding India-Patent Applicaton No. 1071/KOL/2007, dated Apr. 27, 2012.

First Office Action regarding Chinese Patent Application No. 201010224582.3, dated Apr. 17, 2012. English translation provided by Unitalen Attorneys at Law.

* cited by examiner 210
212
214
216
218
220
222
224
230
232
234
235
236
238
240
242
244
246
247
248
250
256
258
260
264
266
267
268
270
272
274
288

318
314
374
310
332
335
320
356
358
388
366
322
360
324
378
368
370
372
362
350
338
334
348
342
330
344
326
312
346
336
316
340

SCROLL COMPRESSOR WITH ROTARY DISCHARGE VALVE

CROSS REFERENCE TO RELATED APPLICATION

This application is a continuation of U.S. patent application Ser. No. 12/103,265 filed on Apr. 15, 2008, which is a continuation of U.S. patent application Ser. No. 11/522,250 filed on Sep. 15, 2006 (now U.S. Pat. No. 7,371,059). The disclosures of the above applications are incorporated herein by reference in its entirety.

FIELD

The present disclosure relates to scroll type machines. More particularly, the present disclosure relates to scroll compressors which incorporate features that reduce the number of components, the size and the complexity of the scroll compressor.

BACKGROUND

The statements in this section merely provide background information related to the present disclosure and may not constitute prior art.

Refrigeration and air conditioning systems generally include a compressor, a condenser, an expansion valve or its equivalent, and an evaporator. These components are coupled in sequence to define a continuous flow path. A working fluid typically called a refrigerant flows through the system and alternates between a liquid phase and a vapor or gaseous phase.

A variety of compressor types have been used in refrigeration systems, including, but not limited to, reciprocating compressors, screw compressors and rotary compressors. Rotary compressors can include both the vane type compressors, the scroll machines as well as other rotary styled compressors.

Scroll machines are becoming more and more popular for the compressor of choice in both refrigeration as well as air conditioning applications due primarily to their capability for extremely efficient operation. Scroll compressors are typically constructed using two scroll members with each scroll member having an end plate and a spiral wrap extending from the end plate. The spiral wraps are arranged in an opposing manner with the two spiral wraps being interfitted. The scroll members are mounted so that they may engage in relative orbiting motion with respect to each other. During this orbiting movement, the spiral wraps define a successive series of enclosed spaces, each of which progressively decreases in size as it moves inwardly from a radially outer position at a relatively low suction pressure to a central position at a relatively high discharge pressure. The compressed gas exits from the enclosed space at the central position through a discharge passage formed through the end plates of one of the scroll members.

An electric motor or another power source is provided which operates to drive one of the scroll members via a suitable drive shaft affixed to the motor rotor. In a hermetic compressor, the bottom of the hermetic shell normally contains an oil sump for lubricating and cooling the various components of the compressor.

Relative rotation between the two scroll members is typically controlled by an anti-rotation mechanism. One of the more popular anti-rotation mechanisms is an Oldham coupling, which is keyed to either the two scroll members or to one of the scroll members and a stationary component such as a bearing housing. While Oldham couplings are a popular choice, other anti-rotation mechanisms may also be utilized.

Due to the increasing popularity of scroll compressors, the continued development of these compressors has been directed towards designs that reduce size, reduce complexity and reduce cost without adversely affecting the performance of the scroll compressor.

SUMMARY

A scroll compressor is provided and may include an orbiting scroll member having an orbiting end plate and an orbiting spiral wrap extending from the orbiting end plate. The scroll compressor may also include a non-orbiting scroll member having a non-orbiting end plate and a non-orbiting spiral wrap extending from the non-orbiting end plate and intermeshed with the orbiting spiral wrap. The scroll compressor may further include a drive member for causing the orbiting scroll member to orbit relative to the non-orbiting scroll member and a discharge slot formed by one of the orbiting scroll member and the non-orbiting scroll member. A discharge valve may be rotatable with the drive member and may operate between a closed state preventing fluid communication between the pockets and the discharge slot and an open state permitting fluid communication between the pockets and the discharge slot.

In another configuration, a scroll compressor is provided and may include an orbiting scroll member having an orbiting end plate and an orbiting spiral wrap extending from the orbiting end plate and a non-orbiting scroll member having a non-orbiting end plate, a non-orbiting spiral wrap extending from the non-orbiting end plate, and a discharge slot. The non-orbiting spiral wrap may be intermeshed with the orbiting spiral wrap to create pockets of progressively changing volume between a suction pressure zone and a discharge pressure zone. The scroll compressor may also include a bearing housing extending from the non-orbiting end plate and a drive member that causes the orbiting scroll member to orbit relative to the non-orbiting scroll member to compress a fluid within the pockets. The drive member may extend through the bearing housing, the non-orbiting scroll member, and the orbiting scroll member. A discharge valve may be rotatable with the drive member and may operate between a closed state preventing fluid communication between the pockets and the discharge slot and an open state permitting fluid communication between the pockets and the discharge slot.

Further areas of applicability will become apparent from the description provided herein. It should be understood that the description and specific examples are intended for purposes of illustration only and are not intended to limit the scope of the present disclosure.

BRIEF DESCRIPTION OF THE DRAWINGS

The drawings described herein are for illustration purposes only and are not intended to limit the scope of the present disclosure in any way.

FIG. 8 is a perspective view similar to FIG. 2, with the addition of an upper bearing retainer for supporting the drive shaft as shown in FIG. 7;

FIG. 17 is a perspective view of the non-orbiting scroll machine illustrated in FIG. 16.

DETAILED DESCRIPTION

The following description is merely exemplary in nature and is not intended to limit the present disclosure, application, or uses.

Figure 1:
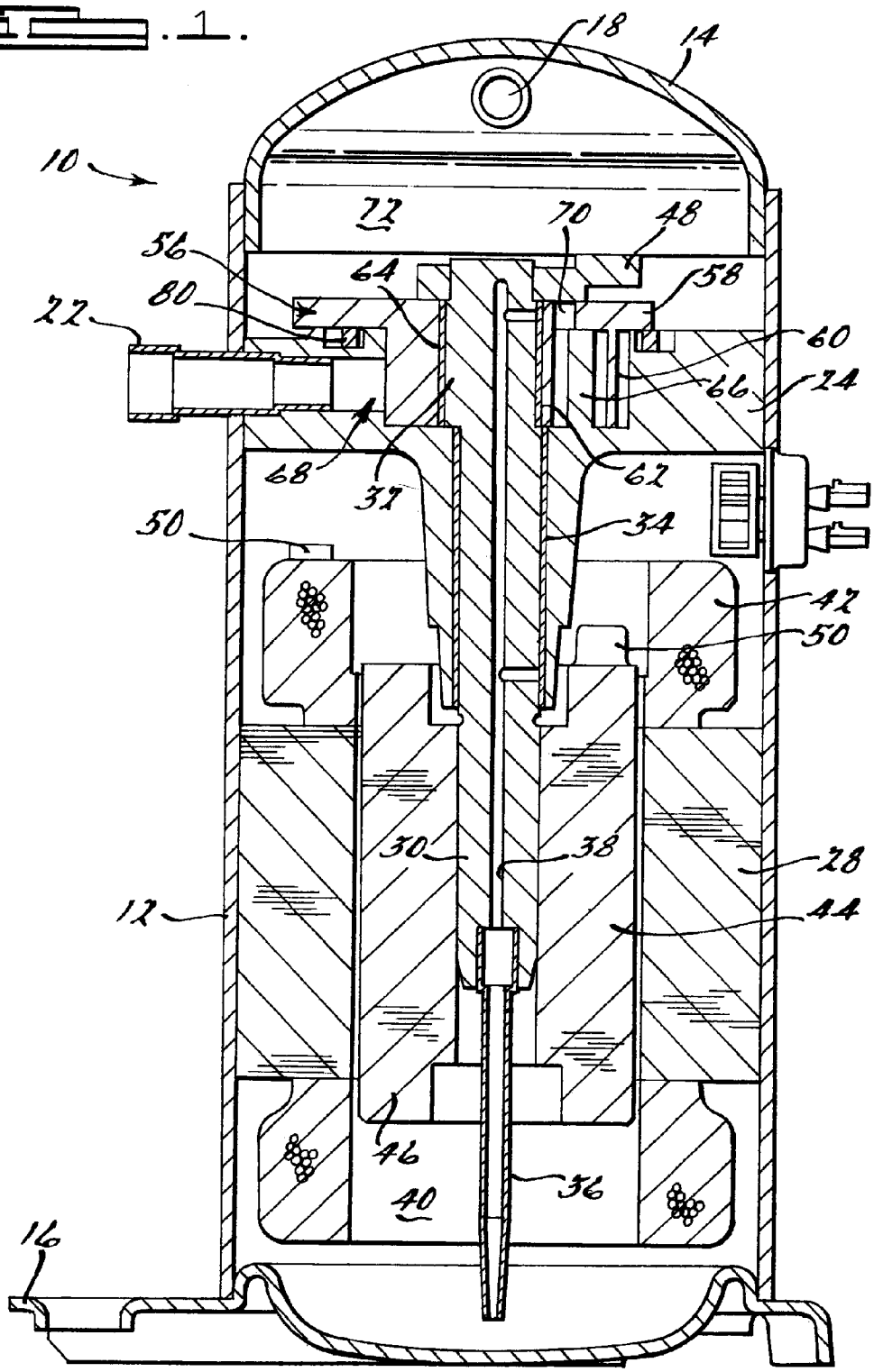
FIG. 1 is a vertical cross-section of a scroll compressor incorporating the unique design features of the present invention.
Figure 2:
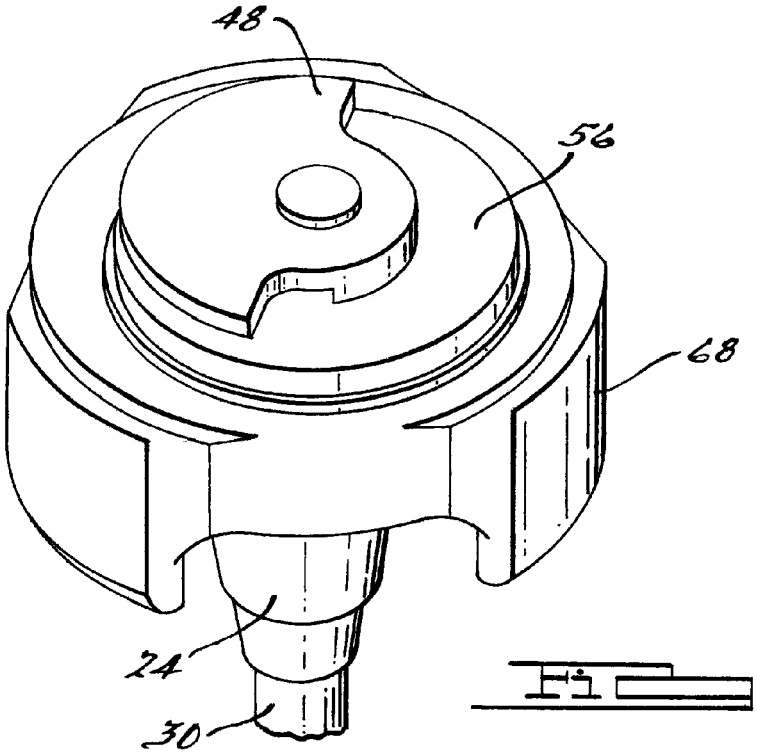
FIG. 2 is a perspective view illustrating the two scroll members, the counterweight, the Oldham coupling, and the drive shaft of the compressor shown in FIG. 1.
Figure 3:
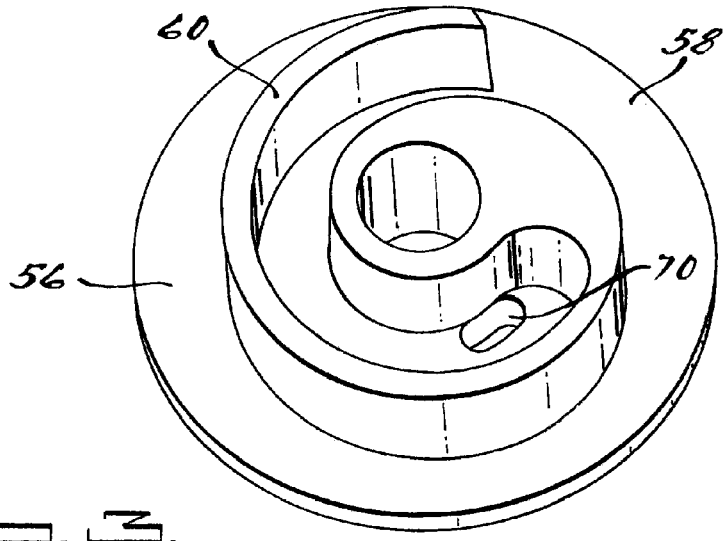
FIG. 3 is a perspective view illustrating the scroll wrap profile of the orbiting scroll member shown in FIG. 1.
Figure 4:
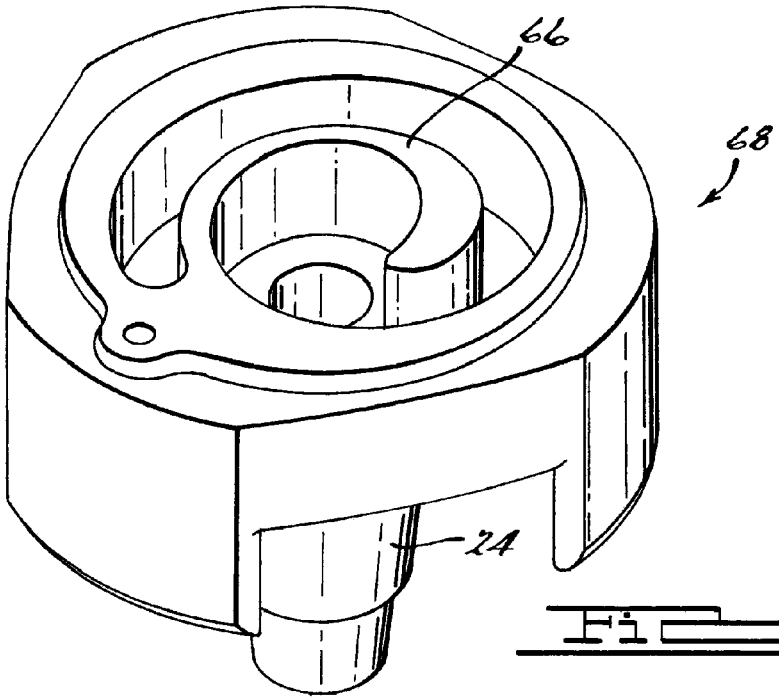
FIG. 4 is a perspective view illustrating the scroll wrap profile of the non-orbiting scroll member shown in FIG. 1.

Referring now to the drawings in which like reference numerals designate like or corresponding parts throughout the several views, there is shown in FIG. 1 a scroll compressor that incorporates the unique design features of the present invention and which is designated generally by the reference numeral 10.

Scroll compressor 10 comprises a general cylindrical hermetic shell 12 having welded at the upper end thereof a caps 14 and at the lower end thereof a base 16 having a plurality of mounting feet (not shown) integrally formed therewith. Cap 14 is provided with a refrigerant discharge fitting 18, which may have the usual discharge valve therein (not shown). Other major elements affixed to shell 12 include an inlet fitting 22, a main bearing housing 24 that is suitably secured to shell 12, and a motor stator 28. Motor stator 28 is generally square in cross-section, but with the corners rounded off to allow for the press fitting of motor stator 28 within shell 12. The flats between the rounded corners on motor stator 28 provide passageways between motor stator 28 and shell 12, which facilitate the return flow of the lubricant from the top of shell 12 to its bottom.

A drive shaft or crankshaft 30 having an eccentric crank pin 32 at the upper end thereof is rotatably journaled in a bearing 34 in main bearing housing 24. Crankshaft 30 has at the lower end thereof a tubular extension 36 that communicates with a radially inclined and outwardly located bore 38 extending upwardly therefrom to the top of crank pin 32. The lower portion of the interior of shell 12 forms an oil sump 40 that is filled with lubricating oil. Tubular extension 36 extends into oil sump 40 and tubular extension 36, in conjunction with bore 38, acts as a pump to pump the lubricating oil up crankshaft 30 and ultimately to all of the various portions of compressor 10 that require lubricating.

Crankshaft 30 is driven by an electric motor that includes motor stator 28 having windings 42 passing therethrough and a motor rotor 44 press fitted onto crankshaft 30. A lower counterweight 46 is attached to motor rotor 44 and an upper counterweight 48 is attached to the upper-end of crankshaft 30. A motor protector 50 of the usual type is provided in close proximity to motor windings 42 so that if motor windings 42 exceed their normal operating temperature, motor protector 50 will de-energize the motor.

Crankshaft 30 extends through the central portion of an orbiting scroll member 56. Orbiting scroll member 56 comprises an end plate 58 having a spiral vane or wrap 60 that is designed with a rapid compression profile as described below. Projecting downwardly from end plate 58 is a cylindrical hub 62 having a journal bearing 64 therein and in which is drivingly disposed crank pin 32.

Orbiting scroll wrap 60 meshes with a non-orbiting scroll wrap 66 forming part of a non-orbiting scroll member 68, which is integral with main bearing housing 24. During orbiting movement of orbiting scroll member 56 with respect to non-orbiting scroll member 68, moving pockets of fluid are formed and the fluid is compressed in the fluid pockets as the volume of the fluid pockets reduce as they travel from a radially outer position to a central position of scroll members 56 and 68.

Orbiting scroll member 56 has a radially inwardly disposed discharge port 70, which is in fluid communication with a discharge chamber 72 defined by cap 14 and shell 12. Fluid compressed by the moving pockets between scroll wraps 60 and 66 discharges into discharge chamber 72 through discharge port 70.

Upper counterweight 48 rotates at a position immediately adjacent end plate 58 of orbiting scroll member 56. During the rotation of upper counterweight 48, discharge port 70 is cyclically covered and uncovered by upper counterweight 48, which allows upper counterweight 48 to act as a rotary discharge valve for compressor 10.

Relative rotation of scroll member 56 and 68 is prevented by an Oldham coupling 80 having a first pair of keys slidably disposed in diametrically opposing slots in non-orbiting scroll member 68 and a second pair of keys slidably disposed in diametrically opposing slots in orbiting scroll member 56.

As described above, scroll wraps 60 and 66 define a rapid compression scroll profile. The rapid compression scroll profile provides the advantages of a shorter wrap, lower tool aspect ratios, lower vane aspect ratios, there is no need to machine the back side of end plate 58 other than the race for upper counterweight 48, and it allows orbiting scroll member 56 to be manufactured using a powder medal process. The preferred profile for scroll wraps 60 and 66 is given in the following table where Ri is the initial swing radius bias and $R_G$ is the generating radius bias:

| PROFILED PARAMETERS | | WRAP | | VANE | |
|---|---|---|---|---|---|
| Ri mm | RG mm | Wrap deg | Length mm | Thick mm | Height mm |
| | | Inner Profile | | | |
| 9 | 0 | 158.67 | 25 | — | — |
| 25.653 | 2.864789 | 250 | 140 | 5 | 21.41 |
| | | Outer Profile | | | |
| 15 | 0 | 158.67 | 42 | — | — |
| 21.653 | 2.864789 | 430 | 244 | 5 | 21.41 |

As illustrated in the Figures, main bearing housing 24 and non-orbiting scroll member 68 are an integral component. Preferably, this component is machined from an iron casting and the advantages of having an integral non-orbiting scroll member 68 and main bearing housing 24 include that the bearing bore can be used as a fixture for the machining of non-orbiting scroll wrap 66. By using the bearing bore as a fixture for machining the scroll wrap, the stack-up of tolerances are minimized, the radial compliance is minimized or reduced, and the bearing/gas/flank/axial forces are linked within a single component.

Compressor 10 is preferably a "high side" type, in which the volume defined by shell 12, cap 14 and base 16 is at discharge pressure. In this way, discharge fitting 18 can be conveniently located on shell 12 or cap 14. Inlet fitting 22 sealingly engages and extends through shell 12 and is sealingly received within non-orbiting scroll member 68 to provide gas at suction pressure to compressor 10.

Figure 5:
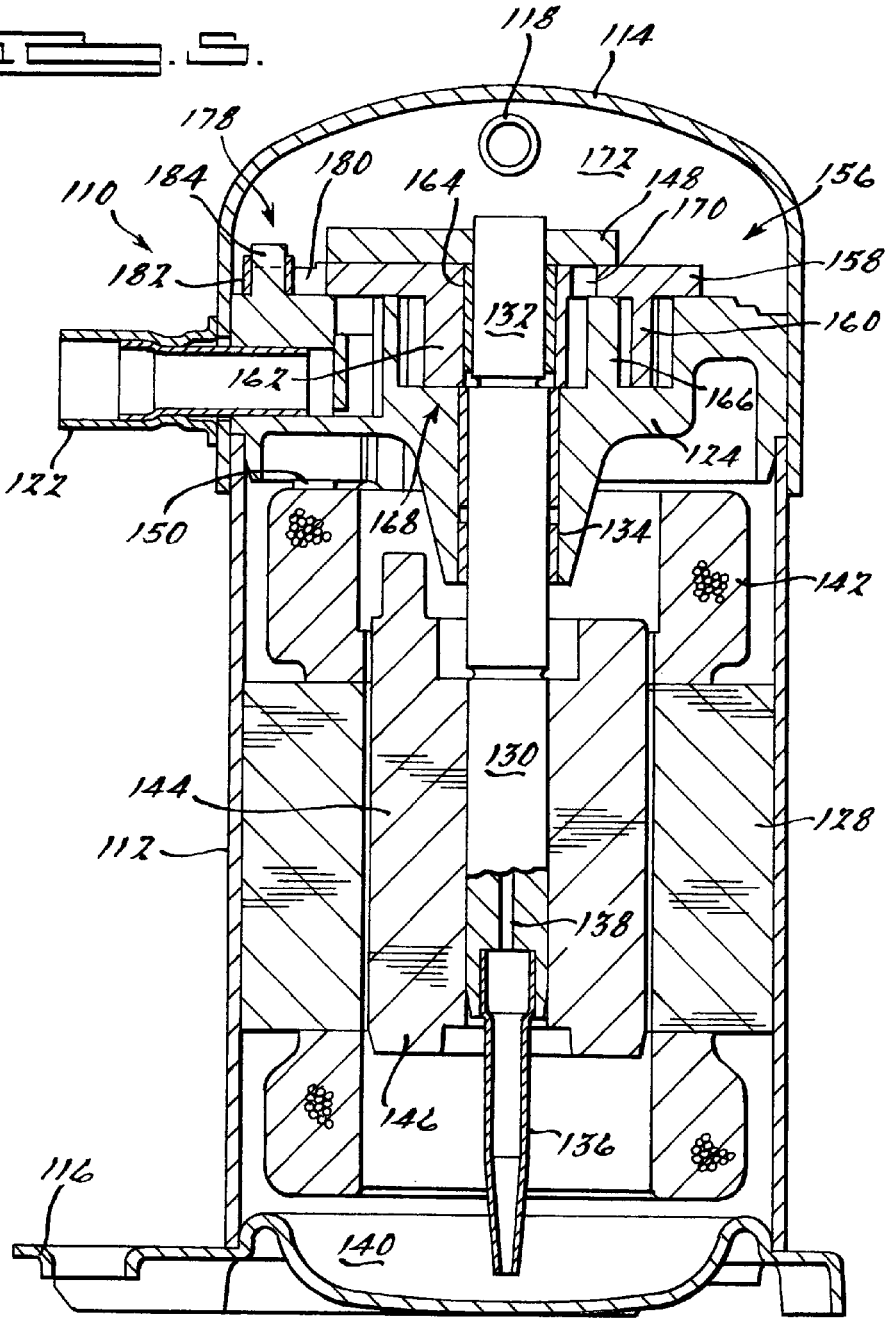
FIG. 5 is a vertical cross-section of a compressor where the Oldham coupling has been replaced with a swing link.

Referring now to FIG. 5, a scroll compressor in accordance with another embodiment of the present invention is illustrated and is designed generally by the reference numeral 110.

Scroll compressor 110 comprises a general cylindrical hermetic shell 112 having welded at the upper end thereof a cap 114 and at the lower end thereof a base 116 having a plurality of mounting feet (not shown) integrally formed therewith. Cap 114 is provided with a refrigerant discharge fitting 118, which may have the usual discharge valve therein (not shown). Other major elements affixed to shell 112 include an inlet fitting 122, a main bearing housing 124 that is suitably secured to shell 112, and a motor stator 128. Motor stator 128 is generally square in cross-section, but with the corners rounded off to allow for the press fitting of motor stator 128 within shell 112. The flats between the rounded corners on motor stator 128 provide passageways between motor stator 128 and shell 112, which facilitate the return flow of the lubricant from the top of shell 112 to its bottom.

A drive shaft or crankshaft 130 having an eccentric crank pin 132 at the upper end thereof is rotatably journaled in a bearing 134 in main bearing housing 124. Crankshaft 130 has at the lower end thereof a tubular extension 136 that communicates with a radially inclined and outwardly located bore 138 extending upwardly therefrom to the top of crank pin 132. The lower portion of the interior of shell 112 forms an oil sump 140 that is filled with lubricating oil. Tubular extension 136 extends into oil sump 140 and tubular extension 136, in conjunction with bore 138, acts as a pump to pump the lubricating oil up crankshaft 130 and ultimately to all of the various portions of compressor 110 that require lubricating.

Crankshaft 130 is driven by an electric motor that includes motor stator 128 having windings 142 passing therethrough and a motor rotor 144 press fitted onto crankshaft 130. A lower counterweight 146 is attached to motor rotor 144 and an upper counterweight 148 is attached to the upper-end of crankshaft 130. A motor protector 150 of the usual type is provided in close proximity to motor windings 142 so that if motor windings 142 exceed their normal operating temperature, motor protector 150 will de-energize the motor.

Crankshaft 130 extends through the central portion of an orbiting scroll member 156. Orbiting scroll member 156 comprises an end plate 158 having a spiral vane or wrap 160 that is designed with a rapid compression profile as described below. Projecting downwardly from end plate 158 is a cylindrical hub 162 having a journal bearing 164 therein and in which is drivingly disposed crank pin 132.

Orbiting scroll wrap 160 meshes with a non-orbiting scroll wrap 166 forming part of a non-orbiting scroll member 168, which is integral with main bearing housing 124. During orbiting movement of orbiting scroll member 156 with respect to non-orbiting scroll member 168, moving pockets of fluid are formed and the fluid is compressed in the fluid pockets as the volume of the fluid pockets reduce as they travel from a radially outer position to a central position of scroll members 156 and 168.

Orbiting scroll member 156 has a radially inwardly disposed discharge port 170, which is in fluid communication with a discharge chamber 172 defined by cap 114 and shell 112. Fluid compressed by the moving pockets between scroll wraps 160 and 166 discharges into discharge chamber 172 through discharge port 170.

Upper counterweight 148 rotates at a position immediately adjacent end plate 158 of orbiting scroll member 156. During the rotation of upper counterweight 148, discharge port 170 is cyclically covered and uncovered by upper counterweight 148, which allows upper counterweight 148 to act as a rotary discharge valve for compressor 110.

Relative rotation of scroll members 156 and 168 is prevented by a swing link 178. Swing link 178 comprises a generally U-shaped extension 180, which is attached to or is integral with end plate 158 of orbiting scroll member 156. U-shaped extension 180 engages a generally rectangular bearing 182, which is pivotably disposed on a post 184 extending from non-orbiting scroll member 168. The engagement between U-shaped extension 180 and bearing 182, in conjunction with the engagement between bearing 182 and post 184, prohibits the rotational movement of orbiting scroll member 156 with respect to non-orbiting scroll member 168, but allows the necessary orbiting movement of orbiting scroll member 156 with respect to non-orbiting scroll member 168 such that the moving pockets are formed and made to move radially inward during the rotation of crankshaft 130.

As described above, scroll wraps 160 and 166 also define a rapid compression scroll profile. The rapid compression scroll profile provides the advantages of a shorter wrap, lower tool aspect ratios, lower vane aspect ratios, there is no need to machine the back side of end plate 158 other than the race for upper counterweight 148, and it allows orbiting scroll member 156 to be manufactured using a powder medal process. The preferred profile for scroll wraps 160 and 166 is given in the following table where Ri is the initial swing radius bias and $R_G$ is the generating radius bias:

| PROFILED PARAMETERS | | WRAP | | VANE | |
|---|---|---|---|---|---|
| Ri mm | RG Mm | Wrap deg | Length mm | Thick mm | Height mm |
| | | Inner Profile | | | |
| 9 | 0 | 158.67 | 25 | — | — |
| 25.653 | 2.864789 | 250 | 140 | 5 | 21.41 |
| | | Outer Profile | | | |
| 15 | 0 | 158.67 | 42 | — | — |
| 21.653 | 2.864789 | 430 | 244 | 5 | 21.41 |

As illustrated in the Figures, main bearing housing 124 and non-orbiting scroll member 168 are an integral component. Preferably, this component is machined from an iron casting and the advantages of having an integral non-orbiting scroll member 168 and main bearing housing 124 include that the bearing bore can be used as a fixture for the machining of non-orbiting scroll wrap 166. By using the bearing bore as a fixture for machining the scroll wrap, the stack-up of tolerances are minimized, the radial compliance is minimized or reduced, and the bearing/gas/flank/axial forces are linked within a single component.

Compressor 110 is preferably a "high side" type, in which the volume defined by shell 112, cap 114 and base 116 is at discharge pressure. In this way, discharge fitting 118 can be conveniently located on shell 112 or cap 114. Inlet fitting 122 sealingly engages and extends through shell 112 and is sealingly received within non-orbiting scroll member 168 to provide gas at suction pressure to compressor 110.

Figure 6:
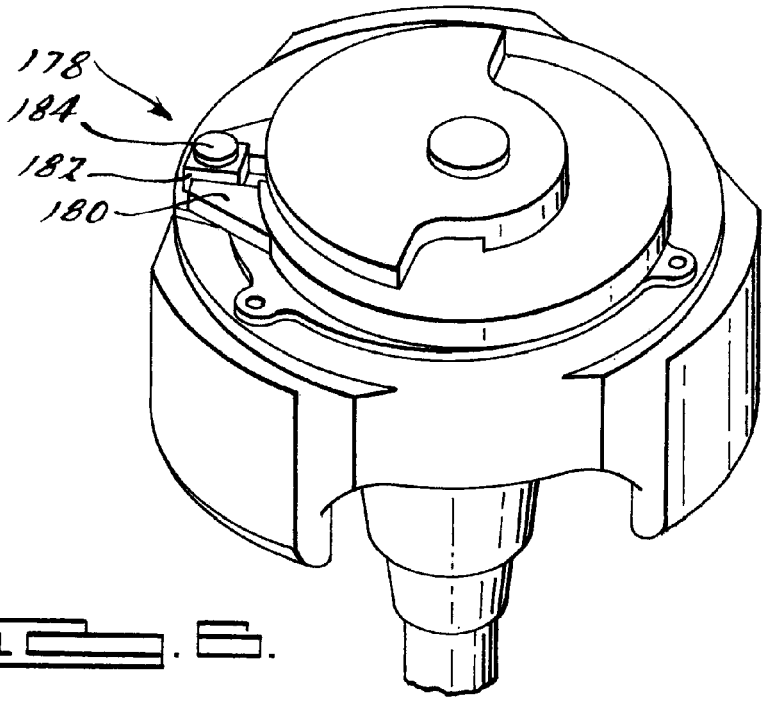
FIG. 6 is a perspective view similar to FIG. 2, but illustrating the swing link in place of the Oldham coupling as illustrated in FIG. 5.
Figure 7:
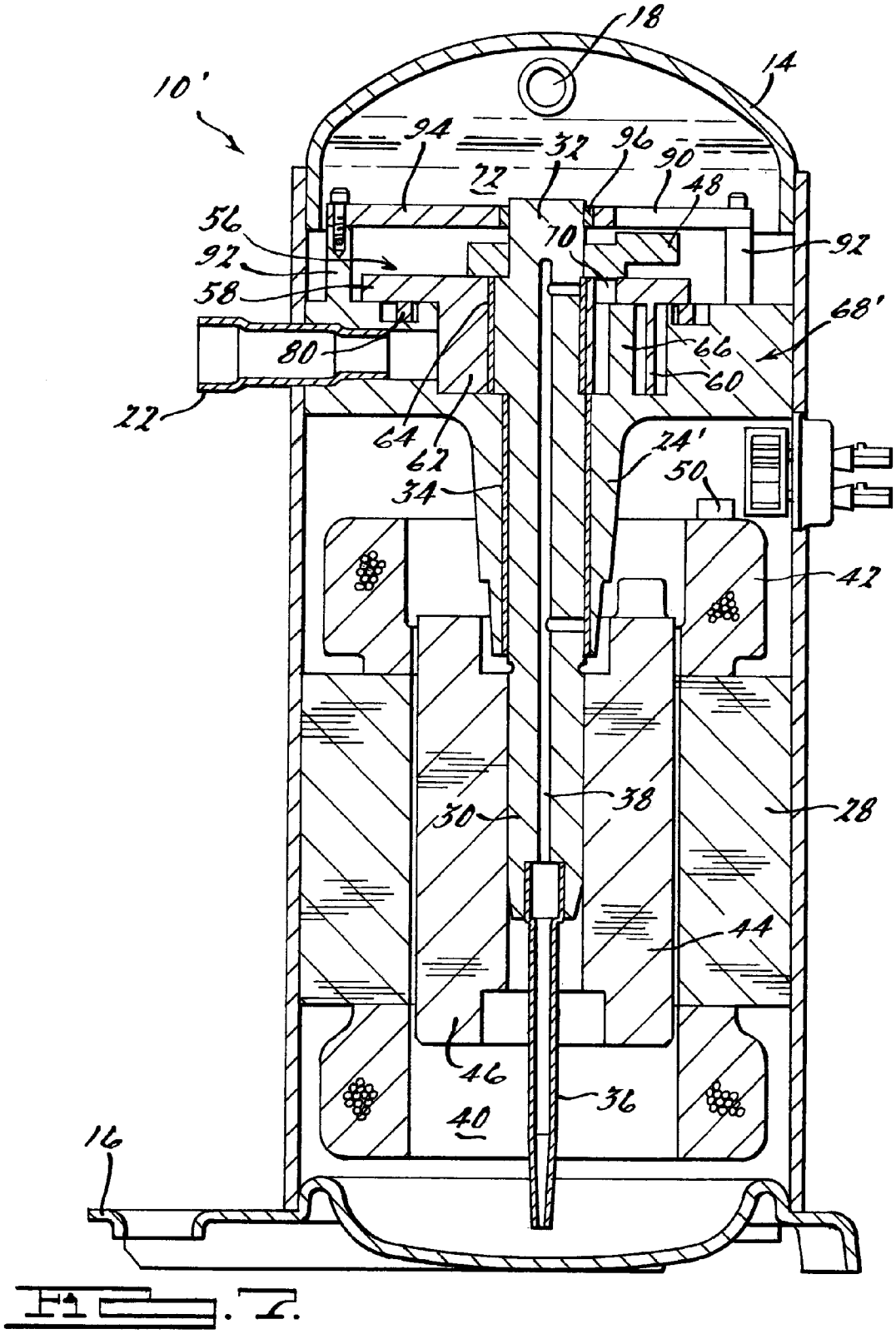
FIG. 7 is a vertical cross-section of a scroll compressor incorporating the unique design features in accordance with another embodiment of the present invention.

Referring now to FIGS. 7 and 8, a compressor 10' in accordance with another embodiment of the present invention is illustrated. Compressor 10' is the same as compressor 10, except that the integral component of main bearing housing 24 and non-orbiting scroll member 68 is replaced with the integral component of main bearing housing 24' and non-orbiting scroll member 68'. Main bearing housing 24' and non-orbiting scroll member 68' are the same as main bearing housing 24 and non-orbiting scroll member 68', except that main bearing housing 24' and non-orbiting scroll member 68' include an upper bearing housing 90. Upper bearing housing 90 includes a plurality of supporting posts 92 and a bearing support 94. Supporting posts 92 are integral with main bearing housing 24' and non-orbiting scroll member 68', or they can be a separate component attached by methods known well in the art. Bearing support 94 is attached to the plurality of supporting posts 92 using a plurality of bolts or by other means known well in the art. The plurality of supporting posts 92 are spaced along the outer periphery of main bearing housing 24' and non-orbiting scroll member 68' such that they do not interfere with upper counterweight 48. Bearing support 94 positions an upper bearing 96 within which crankshaft 30 is rotatably disposed. Thus, crankshaft 30 is supported by bearing 34 located within main bearing housing 24' and by upper bearing 96 located within bearing support 94. The design, function, operation, and advantages associated with compressor 10 are also associated with compressor 10', including, but not limited to, the ability to use Oldham coupling 88 illustrated in FIG. 6 as well as the incorporation of the rapid compression scroll wrap profiles.

Figure 9:
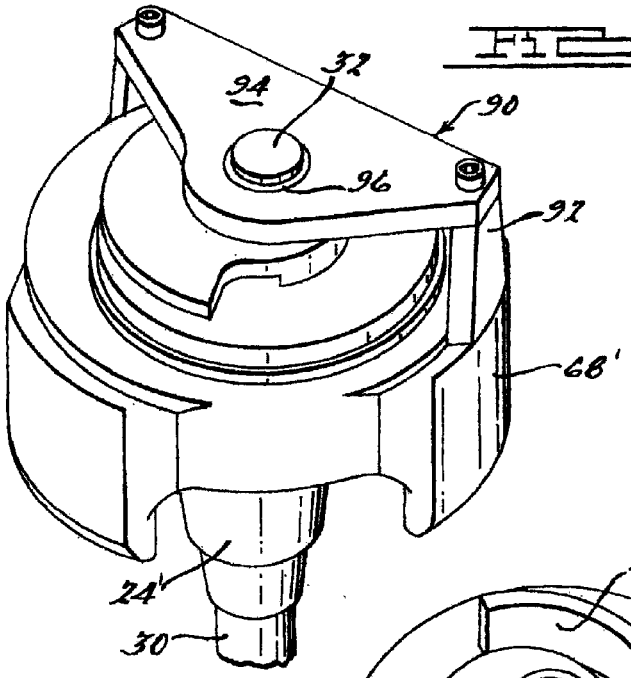
FIG. 9 is a vertical cross-section of a scroll compressor incorporating the unique design features in accordance with another embodiment of the present invention.
Figure 10:
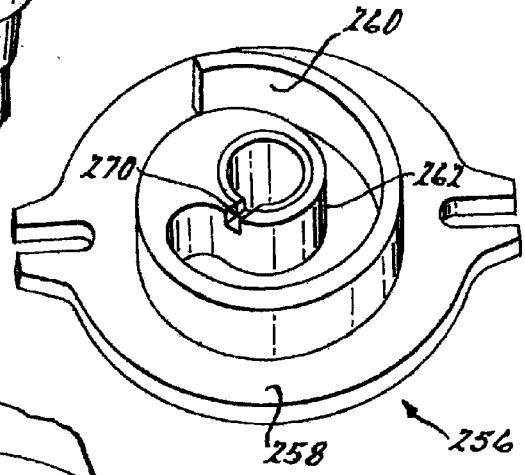
FIG. 10 is a perspective view of the orbiting scroll member illustrated in FIG. 9.
Figure 11:
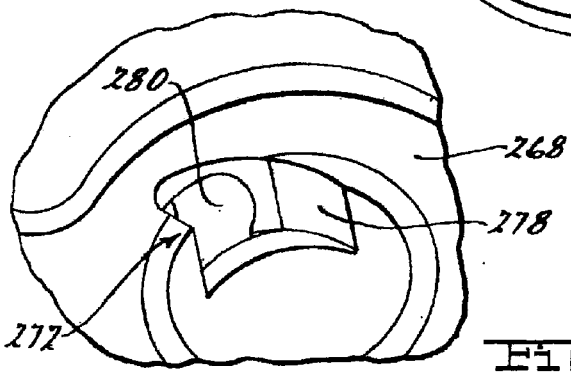
FIG. 11 is an enlarged perspective view of the discharge port of the non-orbiting scroll member illustrated in FIG. 9.
Figure 9:
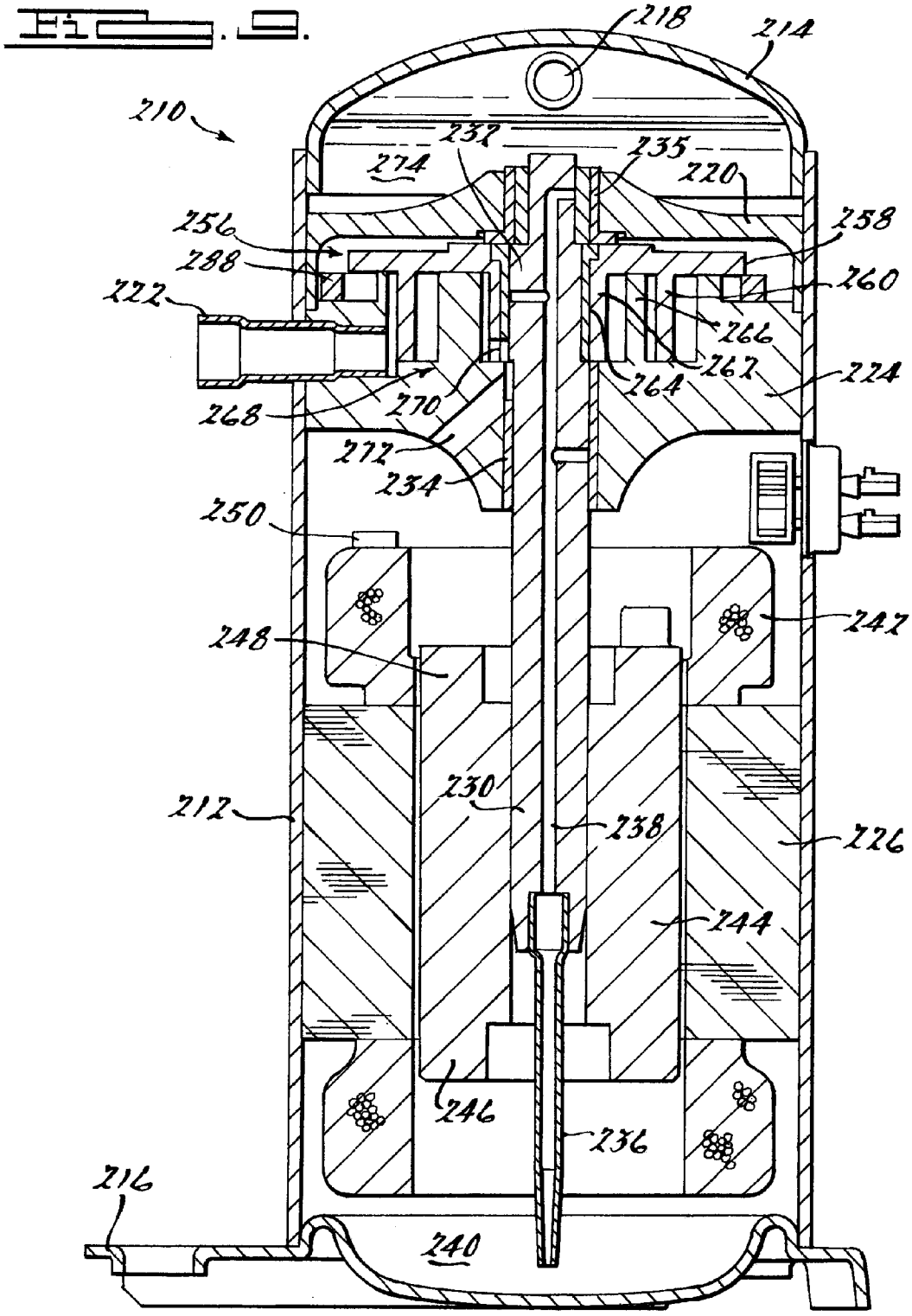

Referring now to FIGS. 9-11, a scroll compressor that incorporates the unique design features in accordance with another embodiment of the present invention is illustrated and it is designated generally by reference numeral 210.

Scroll compressor 210 comprises a general cylindrical hermetic shell 212 having welded at the upper end thereof a cap 214 and at the lower end thereof a base 216 having a plurality of mounting feet (not shown) integrally formed therewith. Cap 214 is provided with a refrigerant discharge fitting 218, which may have the usual discharge valve therein (not shown). Other major elements affixed to shell 212 or cap 214 include an upper bearing housing 220, an inlet fitting 222, a main bearing housing 224 that is suitably secured to shell 212, and a motor stator 226. Motor stator 226 is generally square in cross-section, but with the corners rounded off to allow for the press fitting of motor stator 226 within shell 212. The flats between the rounded corners on motor stator 226 provide passageways between motor stator 226 and shell 212, which facilitate the return flow of the lubricant from the top of shell 212 to its bottom.

A drive shaft or crankshaft 230 having an eccentric crank pin 232 at the upper end thereof is rotatably journaled in a bearing 234 in main bearing housing 224 and in a bearing 235 in upper bearing housing 220. Crankshaft 230 has at the lower end thereof a tubular extension 236 that communicates with a radially included and outwardly located bore 238 extending upwardly therefrom to the top of crank pin 232. The lower portion of the interior of shell 212 forms an oil sump 240 that is filled with lubricating oil. Tubular extension 236 extends into oil sump 240 and tubular extension 236, in conjunction with bore 238, acts as a pump to pump the lubricating oil up crankshaft 230 and ultimately to all of the various portions of compressor 210 that require lubricating.

Crankshaft 230 is driven by an electric motor that includes motor stator 226 having windings 242 passing therethrough and a motor rotor 244 press fitted onto crankshaft 230. A lower counterweight 246 is attached to motor rotor 244 and an upper counterweight 248 is attached to the upper-end of motor rotor 244. A motor protector 250 of the usual type is provided in close proximity to motor windings 242 so that if motor windings 242 exceed their normal operating temperature, motor protector 250 will de-energize the motor.

Crankshaft 230 extends through the central portion of an orbiting scroll member 256. Orbiting scroll member 256 comprises an end plate 258 having a spiral vane or wrap 260 that is designed with a rapid compression profile as described above. Projecting downwardly from end plate 258 is a cylindrical hub 262 having a journal bearing 264 therein and in which is drivingly disposed crank pin 232.

Orbiting scroll wrap 260 meshes with a non-orbiting scroll wrap 266 forming part of a non-orbiting scroll member 268, which is integral with main bearing housing 224. During orbiting movement of orbiting scroll member 256 with respect to non-orbiting scroll member 268, moving pockets of fluid are formed and the fluid is compressed in the fluid pockets as the volume of the fluid pockets reduce as they travel from a radially outer position to a central position of scroll members 256 and 268.

Orbiting scroll member 256 has a radially inwardly disposed discharge slot 270, which is in fluid communication with a discharge port 272 that extends through non-orbiting scroll member 268, which is in communication with a discharge chamber 274 defined by cap 214 and shell 212. Fluid compressed by the moving pockets between scroll wraps 260 and 266 discharges into discharge chamber 274 through discharge slot 270 and discharge port 272.

Relative rotation of scroll members 256 and 268 is prevented by the usual Oldham coupling 288 having a first pair of keys slidably disposed in diametrically opposing slots in non-orbiting scroll member 268 and a second pair of keys slidably disposed in diametrically opposing slots in orbiting scroll member 256, as illustrated in FIG. 9. While FIG. 9 illustrates Oldham coupling 288 as the mechanism for preventing relative rotation of scroll members 256 and 268, it is within the scope of the present invention to replace Oldham coupling 288 with swing link 78 described above if desired.

As described above, scroll wraps 260 and 266 define a rapid compression scroll profile. The rapid compression scroll profile provides the advantages of a shorter wrap, lower tool aspect ratios, lower vane aspect ratios, and it allows orbiting scroll member 256 to be manufactured using a powder medal process. The preferred profile for scroll wraps 260 and 266 is given in the previous table that describes wraps 60 and 66.

As illustrated in the Figures, main bearing housing 224 and non-orbiting scroll member 268 are an integral component. Preferably, this component is machined from an iron casting and the advantages of having an integral non-orbiting scroll member 268 and main bearing housing 224 include that the bearing bore can be used as a fixture for the machining of non-orbiting scroll wrap 266. By using the bearing bore as a fixture for machining the scroll wrap, the stack-up of tolerances are minimized, the radial compliance is minimized or reduced, and the bearing/gas/flank/axial forces are linked within a single component.

Compressor 210 is preferably a "high side" type, in which the volume defined by shell 212, cap 214 and base 216 is at discharge pressure. In this way, discharge fitting 218 can be conveniently located on shell 212 or cap 214. Inlet fitting 222 sealingly engages and extends through shell 212 and is sealingly received within non-orbiting scroll member 268 to provide gas at suction pressure to compressor 210.

Referring now to FIG. 10, discharge slot 270 of orbiting scroll member 256 is illustrated. Discharge slot 270 extends through cylindrical hub 262 and journal bearing 264, which is press fit into cylindrical hub 262.

Referring now to FIG. 11, discharge port 272 of non-orbiting scroll member 268 is illustrated. Discharge port 272 includes a formed recess 278, which is in communication with an angular bore 280, which is in communication with discharge chamber 274. During the orbiting movement of orbiting scroll member 256, orbiting scroll wrap 260 opens and closes discharge slot 270 and discharge port 272 to allow the compressed gas to move from the inner most moving pocket to discharge chamber 274.

Figure 12:
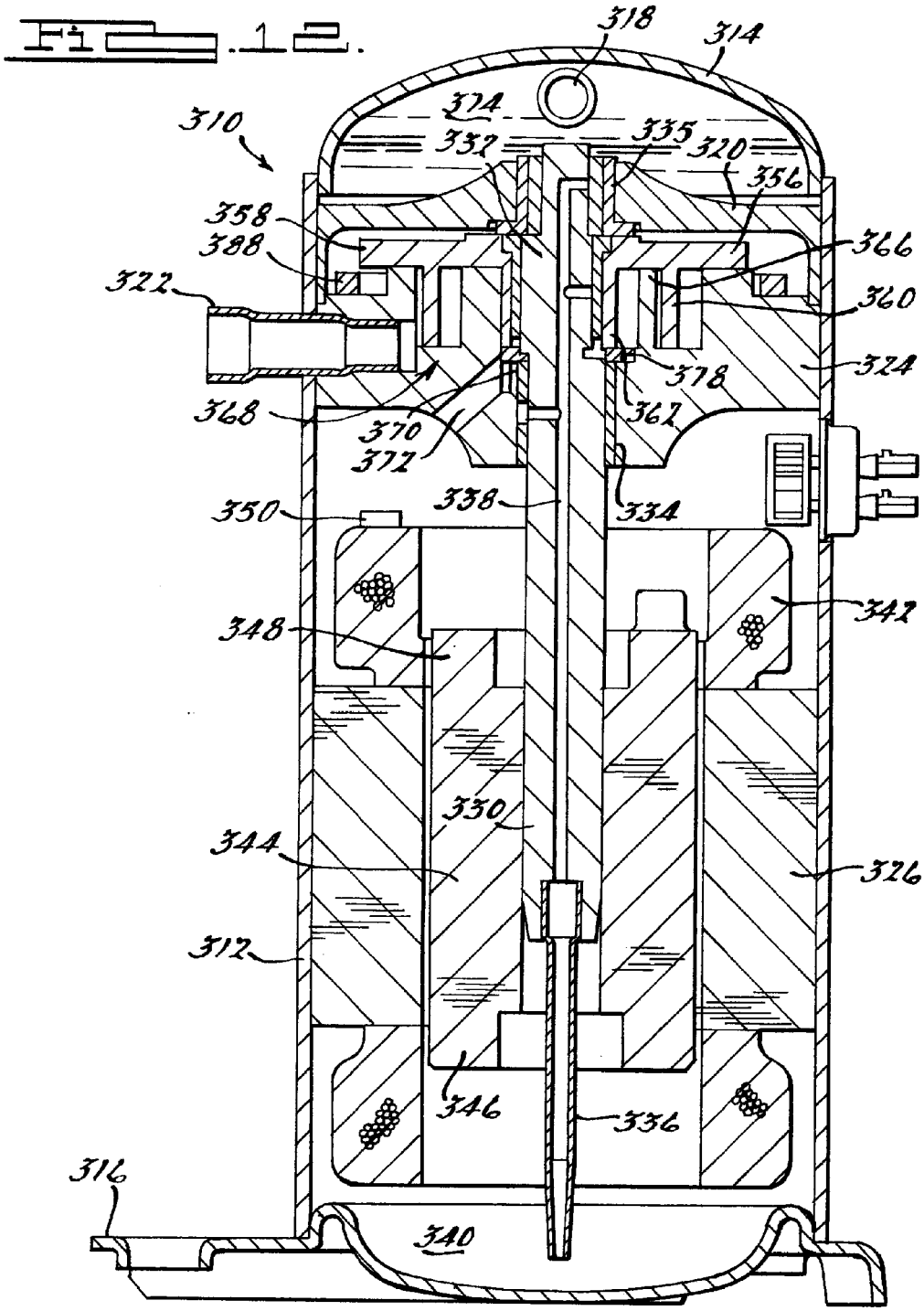
FIG. 12 is a vertical cross-section of a scroll compressor incorporating the unique design features in accordance with another embodiment of the present invention.

Referring now to FIG. 12, a scroll compressor that incorporates the unique design features in accordance with another embodiment of the present invention is illustrated and it is designated generally by reference numeral 310.

Scroll compressor 310 comprises a general cylindrical hermetic shell 312 having welded at the upper end thereof a cap 314 and at the lower end thereof a base 316 having a plurality of mounting feet (not shown) integrally formed therewith. Cap 314 is provided with a refrigerant discharge fitting 318, which may have the usual discharge valve therein (not shown). Other major elements affixed to shell 312 or cap 314 include an upper bearing housing 320, an inlet fitting 322, a main bearing housing 324 that is suitably secured to shell 312, and a motor stator 326. Motor stator 326 is generally square in cross-section, but with the corners rounded off to allow for the press fitting of motor stator 326 within shell 312. The flats between the rounded corners on motor stator 326 provide passageways between motor stator 326 and shell 312, which facilitate the return flow of the lubricant from the top of shell 312 to its bottom.

A drive shaft or crankshaft 330 having an eccentric crank pin 332 at the upper end thereof is rotatably journaled in a bearing 334 in main bearing housing 324 and in a bearing 335 in upper bearing housing 320. Crankshaft 330 has at the lower end thereof a tubular extension 336 that communicates with a radially included and outwardly located bore 338 extending upwardly therefrom to the top of crank pin 332. The lower portion of the interior of shell 312 forms an oil sump 340 that is filled with lubricating oil. Tubular extension 336 extends into oil sump 340 and tubular extension 336, in conjunction with bore 338, acts as a pump to pump the lubricating oil up crankshaft 330 and ultimately to all of the various portions of compressor 310 that require lubricating.

Crankshaft 330 is driven by an electric motor that includes motor stator 326 having windings 342 passing therethrough and a motor rotor 344 press fitted onto crankshaft 330. A lower counterweight 346 is attached to motor rotor 344 and an upper counterweight 348 is attached to the upper-end of motor rotor 244. A motor protector 350 of the usual type is provided in close proximity to motor windings 342 so that if motor windings 342 exceed their normal operating temperature, motor protector 350 will de-energize the motor.

Crankshaft 330 extends through the central portion of an orbiting scroll member 356. Orbiting scroll member 356 comprises an end plate 358 having a spiral vane or wrap 360 that is designed with a rapid compression profile as described above. Projecting downwardly from end plate 358 is a cylindrical hub 362 having a journal bearing therein and in which is drivingly disposed crank pin 332.

Orbiting scroll wrap 360 meshes with a non-orbiting scroll wrap 366 forming part of a non-orbiting scroll member 368, which is integral with main bearing housing 324. During orbiting movement of orbiting scroll member 356 with respect to non-orbiting scroll member 368, moving pockets of fluid are formed and the fluid is compressed in the fluid pockets as the volume of the fluid pockets reduce as they travel from a radially outer position to a central position of scroll members 356 and 368.

Non-orbiting scroll member 368 has a radially inwardly disposed discharge slot 370, which is in fluid communication with a discharge port 372 that extends through non-orbiting scroll member 368, which is in communication with a discharge chamber 374 defined by cap 314 and shell 312. Fluid compressed by the moving pockets between scroll wraps 360 and 366 discharges into discharge chamber 374 through discharge slot 370 and discharge port 372. Discharge slot 370 is a generally axially disposed slot and discharge port 372 is an inclined bore that is in communication with discharge chamber 374.

Relative rotation of scroll members 356 and 368 is prevented by the usual Oldham coupling 388 having a first pair of keys slidably disposed in diametrically opposing slots in non-orbiting scroll member 368 and a second pair of keys slidably disposed in diametrically opposing slots in orbiting scroll member 356, as illustrated in FIG. 12. While FIG. 12 illustrated Oldham coupling 388 as the mechanism for preventing relative rotation of scroll members 356 and 368, it is within the scope of the present invention to replace Oldham coupling 388 with swing link 78 described above if desired.

As described above, scroll wraps 360 and 366 define a rapid compression scroll profile. The rapid compression scroll profile provides the advantages of a shorter wrap, lower tool aspect ratios, lower vane aspect ratios, and it allows orbiting scroll member 356 to be manufactured using a powder medal process. The preferred profile for scroll wraps 360 and 366 is given in the previous table that describes wraps 60 and 66.

As illustrated in the Figures, main bearing housing 324 and non-orbiting scroll member 368 are an integral component. Preferably, this component is machined from an iron casting and the advantages of having an integral non-orbiting scroll member 368 and main bearing housing 324 include that the bearing bore can be used as a fixture for the machining of non-orbiting scroll wrap 366. By using the bearing bore as a fixture for machining the scroll wrap, the stack-up of tolerances are minimized, the radial compliance is minimized or reduced, and the bearing/gas/flank/axial forces are linked within a single component.

Compressor 310 is preferably a "high side" type, in which the volume defined by shell 312, cap 314 and base 316 is at discharge pressure. In this way, discharge fitting 318 can be conveniently located on shell 312 or cap 314. Inlet fitting 322 sealingly engages and extends through shell 312 and is sealingly received within non-orbiting scroll member 368 to provide gas at suction pressure to compressor 310.

Figure 13:
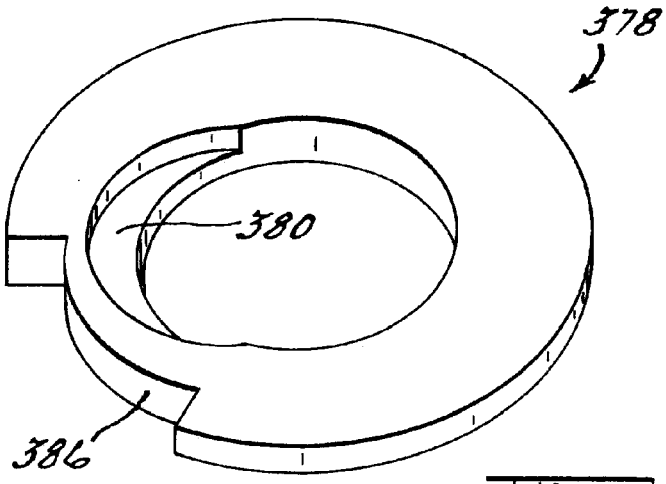
FIG. 13 is a top view of the rotary valve illustrated in FIG. 12.
Figure 14:
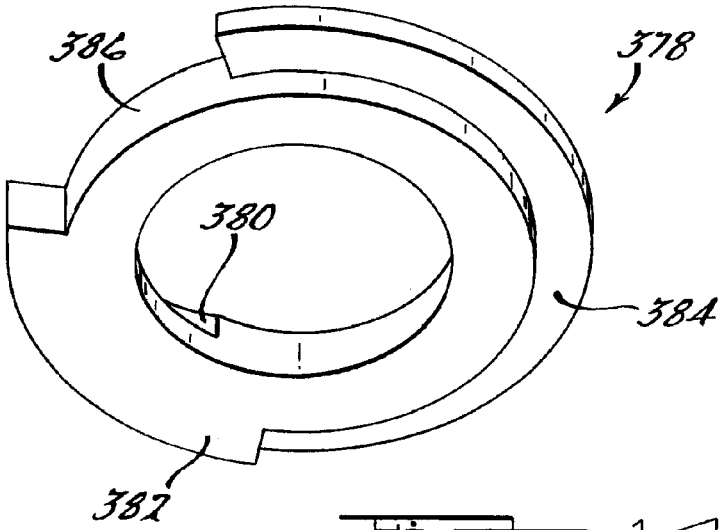
FIG. 14 is a bottom perspective view of the rotary valve illustrated in FIG. 12.

Referring now to FIGS. 12-14, a rotary discharge valve 378 is incorporated into compressor 310. Rotary discharge valve 378 is driven by crankshaft 330 by a formed recess 380, which engages crank pin 332 on its upper side. The lower side of rotary discharge valve 378 includes a port closing section 382, a communication relief section 384 and a port open section 386. As crankshaft 330 rotates, discharge slot 370 is closed when port closing section 382 is above axially disposed slot 370, gas is allowed to flow to discharge port 372 when communication relief section 384 is above axially disposed slot 370, and discharge port 372 is fully open when port open section 386 is above axially disposed slot 370.

Figure 15:
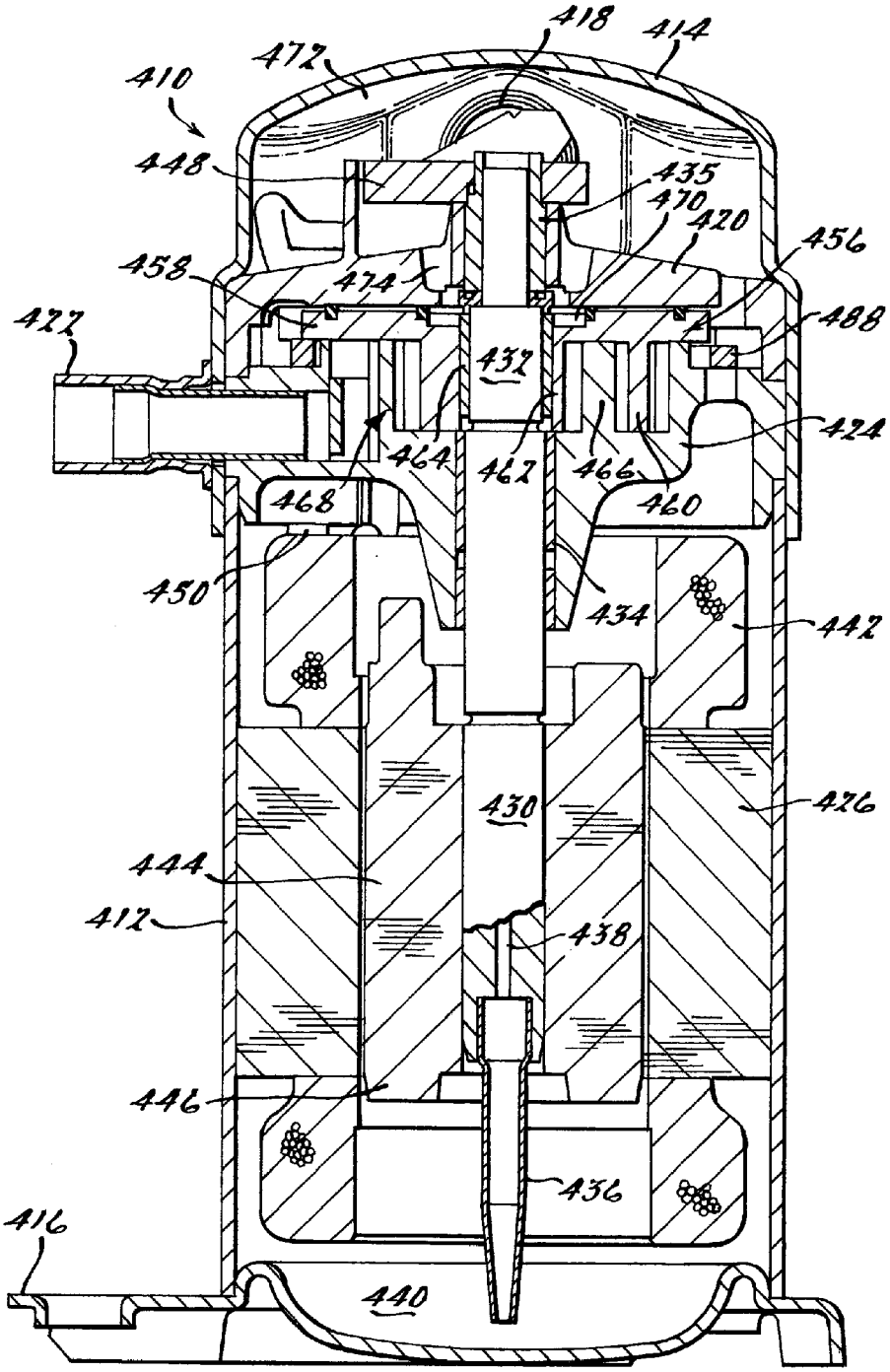
FIG. 15 is a vertical cross-section of a scroll compressor incorporating the unique design features in accordance with another embodiment of the present invention.

Referring now to FIG. 15, a scroll compressor that incorporates the unique design features in accordance with another embodiment of the present invention is illustrated and it is designated generally by reference numeral 410.

Scroll compressor 410 comprises a general cylindrical hermetic shell 412 having welded at the upper end thereof a cap 414 and at the lower end thereof a base 416 having a plurality of mounting feet (not shown) integrally formed therewith. Cap 414 is provided with a refrigerant discharge fitting 418, which may have the usual discharge valve therein (not shown). Other major elements affixed to shell 412 or cap 414 include an upper bearing housing 420, an inlet fitting 422, a main bearing housing 424 that is suitably secured to shell 412 and cap 414, and a motor stator 426. Motor stator 426 is generally square in cross-section, but with the corners rounded off to allow for the press fitting of motor stator 426 within shell 412. The flats between the rounded corners on motor stator 426 provide passageways between motor stator 426 and shell 412, which facilitate the return flow of the lubricant from the top of shell 412 to its bottom.

A drive shaft or crankshaft 430 having an eccentric crank pin 432 at the upper end thereof is rotatably journaled in a bearing 434 in main bearing housing 424 and in a bearing 435 in upper bearing housing 420. Crankshaft 430 has at the lower end thereof a tubular extension 436 that communicates with a radially included and outwardly located bore 438 extending upwardly therefrom to the top of crank pin 432. The lower portion of the interior of shell 412 forms an oil sump 440 that is filled with lubricating oil. Tubular extension 436 extends into oil sump 440 and tubular extension 436, in conjunction with bore 438, acts as a pump to pump the lubricating oil up crankshaft 430 and ultimately to all of the various portions of compressor 410 that require lubricating.

Crankshaft 430 is driven by an electric motor that includes motor stator 426 having windings 442 passing therethrough and a motor rotor 444 press fitted onto crankshaft 430. A lower counterweight 446 is attached to motor rotor 444 and an upper counterweight 448 is attached to the upper-end of crankshaft 430. A motor protector 450 of the usual type is provided in close proximity to motor windings 442 so that if motor windings 442 exceed their normal operating temperature, motor protector 450 will de-energize the motor.

Crankshaft 430 extends through the central portion of an orbiting scroll member 456. Orbiting scroll member 456 comprises an end plate 458 having a spiral vane or wrap 460 that is designed with a rapid compression profile as described above. Projecting downwardly from end plate 458 is a cylindrical hub 462 having a journal bearing 464 therein and in which is drivingly disposed crank pin 432.

Orbiting scroll wrap 460 meshes with a non-orbiting scroll wrap 466 forming part of a non-orbiting scroll member 468, which is integral with main bearing housing 424. During orbiting movement of orbiting scroll member 456 with respect to non-orbiting scroll member 468, moving pockets of fluid are formed and the fluid is compressed in the fluid pockets as the volume of the fluid pockets reduce as they travel from a radially outer position to a central position of scroll members 456 and 468.

Orbiting scroll member 456 has a radially inwardly disposed discharge port 470, which is in fluid communication with a discharge chamber 472 defined by cap 414 and shell 412 through a discharge passage 474 formed in upper bearing housing 420. Fluid compressed by the moving pockets between scroll wraps 460 and 466 discharges into discharge chamber 472 through discharge port 470 and discharge passage 474.

Relative rotation of scroll members 456 and 468 is prevented by the usual Oldham coupling 488 having a first pair of keys slidably disposed in diametrically opposing slots in non-orbiting scroll member 468 and a second pair of keys slidably disposed in diametrically opposing slots in orbiting scroll member 456, as illustrated in FIG. 15. While FIG. 15 illustrates Oldham coupling 488 for preventing relative rotation of scroll members 456 and 468, it is within the scope of the present invention to replace Oldham coupling 488 with swing link 78 described above if desired.

As described above, scroll wraps 460 and 466 define a rapid compression scroll profile. The rapid compression scroll profile provides the advantages of a shorter wrap, lower tool aspect ratios, lower vane aspect ratios, and it allows orbiting scroll member 456 to be manufactured using a powder medal process. The preferred profile for scroll wraps 460 and 466 is given in the previous table which described wraps 60 and 66.

As illustrated in the Figures, main bearing housing 424 and non-orbiting scroll member 468 are an integral component. Preferably, this component is machined from an iron casting and the advantages of having an integral non-orbiting scroll member 468 and main bearing housing 424 include that the bearing bore can be used as a fixture for the machining of non-orbiting scroll wrap 466. By using the bearing bore as a fixture for machining the scroll wrap, the stack-up of tolerances are minimized, the radial compliance is minimized or reduced, and the bearing/gas/flank/axial forces are linked within a single component.

Compressor 410 is preferably a "high side" type, in which the volume defined by shell 412, cap 414 and base 416 is at discharge pressure. In this way, discharge fitting 418 can be conveniently located on shell 412 or cap 414. Inlet fitting 422 sealingly engages and extends through cap 414 and is sealingly received within non-orbiting scroll member 468 to provide gas at suction pressure to compressor 410.

Figure 16:
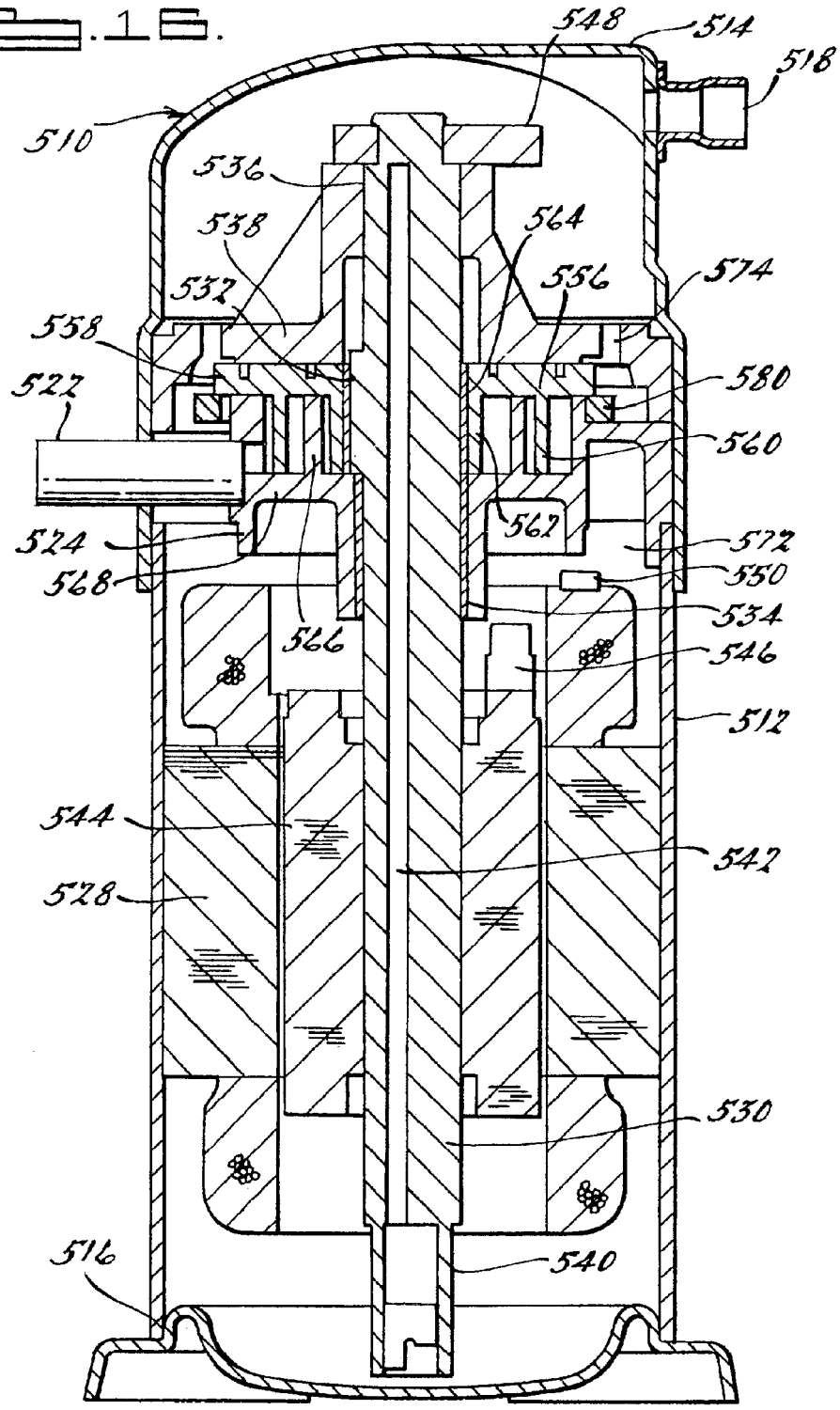
FIG. 16 is a vertical cross-section of a scroll compressor incorporating the unique design features in accordance with another embodiment of the present invention.
Figure 12:
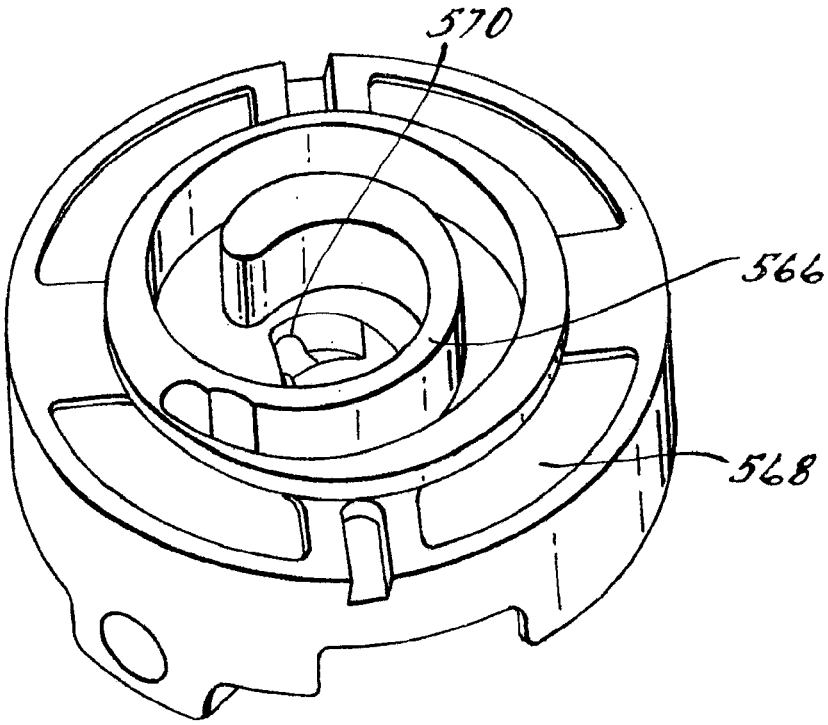

Referring now to FIGS. 16 and 17, a scroll compressor that incorporates the unique features in accordance with another embodiment of the present invention is illustrated and it is designated generally by reference numeral 510.

Scroll compressor 510 comprises a general cylindrical hermetic shell 512 having welded at the upper end thereof a cap 514 and at the lower end thereof a base 516 having a plurality of mounting feet (not shown) integrally formed therewith. Cap 514 is provided with a refrigerant discharge fitting 518, which may have the usual discharge valve therein (not shown). Other major elements affixed to shell 512 include an inlet fitting 522, a main bearing housing 524 that is suitably secured to shell 512, and a motor stator 528. Motor stator 528 is generally square in cross-section, but with the corners rounded off to allow for the press fitting of motor stator 528 within shell 512. The flats between the rounded corners on motor stator 528 provide passageways between motor stator 528 and shell 512, which facilitate the return flow of the lubricant from the top of shell 512 to its bottom.

A drive shaft or crankshaft 530 having an eccentric crank pin 532 is rotatably journaled in a bearing 534 in main bearing housing 524 and a bearing 536 in an outboard bearing structure 538. Outboard bearing structure 538 is attached to a periphery of main bearing housing 524 and to cap 514. Crankshaft 530 has at the lower end thereof a tubular extension 540 that communicates with a radially inclined and outwardly located bore 542 extending upwardly therefrom to lubricate bearing 536. The lower portion of the interior of shell 512 forms an oil sump that is filled with lubricating oil. Tubular extension 540 extends into the oil sump and tubular extension 540, in conjunction with bore 542, acts as a pump to pump the lubricating oil up crankshaft 530 and ultimately to all of the various portions of compressor 510 that require lubricating.

Crankshaft 530 is driven by an electric motor that includes motor stator 528 having windings passing therethrough and a motor rotor 544 press fitted onto crankshaft 530. A lower counterweight 546 is attached to motor rotor 544 and an upper counterweight 548 is attached to the upper-end of crankshaft 530. A motor protector 550 of the usual type is provided in close proximity to the motor windings so that if the motor windings exceed their normal operating temperature, motor protector 550 will de-energize the motor.

Crankshaft 530 extends through the central portion of an orbiting scroll member 556. Orbiting scroll member 556 comprises an end plate 558 having a spiral vane or wrap 560 that is designed with a rapid compression profile as described below. Projecting downwardly from end plate 558 is a cylindrical hub 562 having a journal bearing 564 therein and in which is drivingly disposed crank pin 532. "Threaded" zone of crankshaft 530 between bearing 536 and crank pin 532 is designed in such a way that, during assembly, orbiting scroll member 556 can be assembled over bearing 536.

Orbiting scroll wrap 560 meshes with a non-orbiting scroll wrap 566 forming part of a non-orbiting scroll member 568, which is integral with main bearing housing 524. During orbiting movement of orbiting scroll member 556 with respect to non-orbiting scroll member 568, moving pockets of fluid are formed and the fluid is compressed in the fluid pockets as the volume of the fluid pockets reduce as they travel from a radially outer position to a central position of scroll members 556 and 568.

Orbiting scroll member 556 has a radially inwardly disposed discharge port 570, which is in fluid communication with a discharge chamber 572 defined by cap 514 and shell 512. Fluid compressed by the moving pockets between scroll wraps 560 and 566 discharges into discharge chamber 572 through discharge port 570.

Discharge port 570 (illustrated in greater detail on FIG. 17) is machined into the baseplate of non-orbiting scroll member 566 and enables the discharge gas to escape the compression cavity into discharge chamber 572. The shape of this port determines the relative position, of non-orbiting scroll wrap 566 and orbiting scroll wrap 560, at which a pocket under compression starts to communicate with discharge port 570 and can be determined, by those skilled in the art, to minimize compression loses at a specified operational condition. Through passages 574, the discharge gas moves to the upper portion of cap 514 and leaves compressor 510 through discharge fitting 518.

Relative rotation of scroll member 556 and 568 is prevented by an Oldham coupling 580 having a first pair of keys slidably disposed in diametrically opposing slots in non-orbiting scroll member 568 and a second pair of keys slidably disposed in diametrically opposing slots in orbiting scroll member 556.

As described above, scroll wraps 560 and 566 define a rapid compression scroll profile. The rapid compression scroll profile provides the advantages of a shorter wrap, lower tool aspect ratios, lower vane aspect ratios, there is no need to machine the back side of end plate 558 other than the race for upper counterweight 548, and it allows orbiting scroll member 556 to be manufactured using a powder medal process. The preferred profile for scroll wraps 560 and 566 is given in the following table where Ri is the initial swing radius bias and $R_G$ is the generating radius bias:

| PROFILED PARAMETERS | | WRAP | | VANE | |
|---|---|---|---|---|---|
| Ri mm | RG mm | Wrap deg | Length mm | Thick mm | Height mm |
| | | Inner Profile | | | |
| 9 | 0 | 158.67 | 25 | — | — |
| 25.653 | 2.864789 | 250 | 140 | 5 | 21.41 |
| | | Outer Profile | | | |
| 15 | 0 | 158.67 | 42 | — | — |
| 21.653 | 2.864789 | 430 | 244 | 5 | 21.41 |

As illustrated in the Figures, main bearing housing 524 and non-orbiting scroll member 568 are an integral component. Preferably, this component is machined from an iron casting and the advantages of having an integral non-orbiting scroll member 568 and main bearing housing 524 include that the bearing bore can be used as a fixture for the machining of non-orbiting scroll wrap 566. By using the bearing bore as a fixture for machining the scroll wrap, the stack-up of tolerances are minimized, the radial compliance is minimized or reduced, and the bearing/gas/flank/axial forces are linked within a single component.

Compressor 510 is preferably a "high side" type, in which the volume defined by shell 512, cap 514 and base 516 is at discharge pressure. In this way, discharge fitting 518 can be conveniently located on shell 512 or cap 514. Inlet fitting 522 sealingly engages and extends through shell 512 and is sealingly received within non-orbiting scroll member 568 to provide gas at suction pressure to compressor 510.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A scroll compressor comprising:

an orbiting scroll member having an orbiting end plate and an orbiting spiral wrap extending from said orbiting end plate;

a non-orbiting scroll member having a non-orbiting end plate and a non-orbiting spiral wrap extending from said non-orbiting end plate, said non-orbiting spiral wrap being intermeshed with said orbiting spiral wrap to create pockets of progressively changing volume between a suction pressure zone and a discharge pressure zone;

a drive member for causing said orbiting scroll member to orbit relative to said non-orbiting scroll member to compress a fluid within said pockets;

a discharge slot formed by one of said orbiting scroll member and said non-orbiting scroll member; and a discharge valve rotatable with said drive member and operable between a closed state preventing fluid communication between said pockets and said discharge slot and an open state permitting fluid communication between said pockets and said discharge slot.

2. The scroll compressor of claim 1, wherein said discharge slot is formed in said non-orbiting scroll member.

3. The scroll compressor of claim 1, wherein said discharge valve includes a recess operable to receive a portion of said drive member to fix said discharge valve for rotation with said drive member.

4. The scroll compressor of claim 1, wherein said discharge valve includes a recess operable to receive a crank pin to fix said discharge valve for rotation with said drive member.

5. The scroll compressor of claim 1, wherein said discharge valve is disposed proximate to said non-orbiting end plate.

6. The scroll compressor of claim 1, further comprising a discharge port extending through said non-orbiting scroll member.

7. The scroll compressor of claim 6, wherein said discharge port is in fluid communication with said discharge slot at a first end and is in fluid communication with said discharge pressure zone at a second end.

8. The scroll compressor of claim 6, wherein said discharge port is an inclined bore formed at an angle relative to a longitudinal axis of said drive member.

9. The scroll compressor of claim 1, wherein said orbiting spiral wrap and said non-orbiting spiral wrap define a rapid compression scroll profile.

10. The scroll compressor of claim 1, further comprising a bearing housing formed integrally with said non-orbiting end plate.

11. The scroll compressor of claim 1, further comprising a bearing housing extending from said non-orbiting end plate, said drive member extending through said bearing housing, said non-orbiting scroll member, and said orbiting scroll member.

12. A scroll compressor comprising:

an orbiting scroll member having an orbiting end plate and an orbiting spiral wrap extending from said orbiting end plate;

a non-orbiting scroll member having a non-orbiting end plate, a non-orbiting spiral wrap extending from said non-orbiting end plate, and a discharge slot, said non-orbiting spiral wrap being intermeshed with said orbiting spiral wrap to create pockets of progressively changing volume between a suction pressure zone and a discharge pressure zone;

a bearing housing extending from said non-orbiting end plate;

a drive member for causing said orbiting scroll member to orbit relative to said non-orbiting scroll member to compress a fluid within said pockets, said drive member extending through said bearing housing, said non-orbiting scroll member, and said orbiting scroll member; and a discharge valve rotatable with said drive member and operable between a closed state preventing fluid communication between said pockets and said discharge slot and an open state permitting fluid communication between said pockets and said discharge slot.

13. The scroll compressor of claim 12, wherein said discharge valve includes a recess operable to receive a portion of said drive member to fix said discharge valve for rotation with said drive member.

14. The scroll compressor of claim 12, wherein said discharge valve includes a recess operable to receive a crank pin to fix said discharge valve for rotation with said drive member.

15. The scroll compressor of claim 12, wherein said discharge valve is disposed proximate to said non-orbiting end plate.

16. The scroll compressor of claim 12, further comprising a discharge port extending through said non-orbiting scroll member.

17. The scroll compressor of claim 16, wherein said discharge port is in fluid communication with said discharge slot at a first end and is in fluid communication with said discharge pressure zone at a second end.

18. The scroll compressor of claim 16, wherein said discharge port is an inclined bore formed at an angle relative to a longitudinal axis of said drive member.

19. The scroll compressor of claim 12, wherein said orbiting spiral wrap and said non-orbiting spiral wrap define a rapid compression scroll profile.

20. The scroll compressor of claim 12, wherein said bearing housing is formed integrally with said non-orbiting end plate.

21. The scroll compressor of claim 12, wherein said discharge valve includes a port closing section, a port open section, and a communication relief section, said discharge valve permitting fluid communication between said pockets and said discharge slot when said port open section or said communication relief section opposes said discharge slot.

* * * * *

UNITED STATES PATENT AND TRADEMARK OFFICE

CERTIFICATE OF CORRECTION

PATENT NO. : 8,393,882 B2
APPLICATION NO. : 13/036529
DATED : March 12, 2013
INVENTOR(S) : Kirill Ignatiev et al.

It is certified that error appears in the above-identified patent and that said Letters Patent is hereby corrected as shown below:

| | |
|---|---|
| On the Title Page | |
| Item (56) Other Publications, Line 3 | Delete "200710153687.2,translated" and insert --200710153687.2, translated--. |
| In the Specification | |
| Column 4, Line 47 | Before "end", insert --to--. |
| Column 5, Line 5 | Delete "RG" and insert --$R_G$--. |
| Column 6, Line 37 | Before "end", insert --to--. |
| Column 7, Line 5 | Delete "RG" and insert --$R_G$--. |
| Column 7, Line 6 | Delete "Mm" and insert --mm--. |
| Column 9, Line 5 | Delete "78" and insert --178--. |
| Column 10, Line 16 | Delete "244" and insert --344--. |
| Column 10, Line 56 | Delete "78" and insert --178--. |
| Column 12, Line 37 | Delete "78" and insert --178--. |
| Column 14, Line 32 | Delete "RG" and insert --$R_G$--. |

Signed and Sealed this
Twenty-fourth Day of September, 2013

Teresa Stanek Rea
*Deputy Director of the United States Patent and Trademark Office*